US008339763B2

(12) United States Patent
McNulty, Jr.

(10) Patent No.: US 8,339,763 B2
(45) Date of Patent: Dec. 25, 2012

(54) ELECTRIC DISCHARGE WEAPON FOR USE AS FOREND GRIP OF RIFLES

(76) Inventor: James F. McNulty, Jr., Las Vegas, NV (US)

( * ) Notice: Subject to any disclaimer, the term of this patent is extended or adjusted under 35 U.S.C. 154(b) by 499 days.

(21) Appl. No.: 12/658,446

(22) Filed: Feb. 5, 2010

(65) Prior Publication Data

US 2010/0146835 A1 Jun. 17, 2010

Related U.S. Application Data

(63) Continuation-in-part of application No. 10/929,618, filed on Aug. 30, 2004, now abandoned, which is a continuation-in-part of application No. 10/237,275, filed on Sep. 9, 2002, now Pat. No. 6,782,789.

(51) Int. Cl.
*F41C 9/00* (2006.01)

(52) U.S. Cl. ..... 361/232; 42/1.08

(58) Field of Classification Search ..... 361/232; 42/1.08; 102/502
See application file for complete search history.

(56) References Cited

U.S. PATENT DOCUMENTS 3,803,463 A 4/1974 Cover
5,654,867 A 8/1997 Murray
5,698,815 A 12/1997 Ragner
5,831,199 A 11/1998 McNulty, Jr. et al.
7,409,912 B2 * 8/2008 Cerovic et al. ..... 102/502
2006/0120009 A1 * 6/2006 Chudy ..... 361/232

FOREIGN PATENT DOCUMENTS

WO WO 2008/080058 7/2008

* cited by examiner

*Primary Examiner* — Danny Nguyen
(74) *Attorney, Agent, or Firm* — Leonard Tachner

(57) ABSTRACT

A TASER® and a vertical grip are combined to be attached to the stud post under the forend or the barrel of a conventional long arm. A TASER® may also be combined with the forend or barrel of a conventional long arm itself. Stud posts come standard on certain long arms like the M-16 rifle. Stud posts can be installed on single shot and pump action shotgun forends as well. The TASER® power supply can serve as a power source for a strobe lamp, which may be sighted by rescuers either visually or with infrared night viewing or other special viewing equipment for miles. The optical signal could be produced in the infrared, visible light and ultraviolet light regions of the electromagnetic spectrum. The signal lamp is inserted into a TASER®'s firing chamber in lieu of an ammunition cartridge.

16 Claims, 8 Drawing Sheets

ELECTRIC DISCHARGE WEAPON FOR USE AS FOREND GRIP OF RIFLES

RELATION TO CORRESPONDING APPLICATIONS

This application is a continuation-in-part of application Ser. No. 10/929,618 filed on Aug. 30, 2004 which is a continuation-in-part of Ser. No. 10/237,275 filed on Sep. 9, 2002 and now issued as U.S. Pat. No. 6,782,789.

BACKGROUND OF THE INVENTION

1. Field of the Invention

The present invention relates generally to apparatus for improving the versatility of rifles and more specifically to a forend grip configured to provide an electrical discharge weapon (i.e., TASER®) which can receive either a cartridge having wire-tethered darts or a strobe light for signaling friends or for blinding enemies.

2. Background Art

TASER®'s are weapons that can connect a disabling shock from a remote power supply to a violent assailant. The TASER® launches a pair of electrically opposed darts with trailing wires from its power supply to an assailant to connect the assailant to the supply. TASER®s have a lower lethality than conventional firearms. U.S. Pat. No. 3,803,463 was issued to Cover for the TASER® in 1974. Since that time, the TASER® has seen application in the United States as a law enforcement tool and the U.S. military has interest in the TASER® for policing actions. TASER®s are regularly used by peace officers to humanely capture suicidal or otherwise violent, even armed suspects, who are themselves victims of intoxicants, drugs and/or emotional disturbance, without serious injury to suspects, officers or bystanders.

The main problem with the TASER®, which has several tactical limitations, is that it is a discrete weapon. To be readily accessible for potential application, it must be separately holstered on the already quite limited space on a peace officer's utility belt or otherwise on the already quite limited space available for additional ordnance and weight on the person of the peace officer or soldier. Sufficient unused space to holster a TASER® may not be available. The TASER® is necessarily a relatively large side arm. The space needed to isolate the weapons' arcing high voltage circuitry. A typical TASER® is described in U.S. Pat. No. 5,654,867 to Murray. At least partially for the above reasons, the TASER® has only been deployed on a limited basis by law enforcement, and the TASER® has not seen use in military policing actions. Deployment of conventional weapons could be reduced and countless lives saved and injuries avoided, if the TASER® were more convenient for peace officers to bear and, thereby, more available for their use.

Combining the TASER® with a conventional firearm can overcome the TASER®'s heretofore described storage and transport disadvantages. Several patentees, including the inventor herein, have previously attempted to combine the TASER® with conventional firearms. U.S. Pat. No. 5,698,815 issued to Ragner. The Ragner apparatus has proved impractical and has never been commercially manufactured. U.S. Pat. No. 5,831,199 issued to McNulty. With the current state of the art, the ammunition cartridge described therein can only be manufactured as a minimum 38 to 40 mm diameter and 8" length cartridge and is, therefore, only suitable for discharge through the barrels of certain breech loading tear gas guns. Manufactured as the discharger cup described in the specification, the apparatus has no transport or storage advantages over discrete TASER®'s.

SUMMARY OF THE INVENTION

In the present invention a TASER® and a vertical grip are combined to be attached to the stud post under the forend or the barrel of a conventional long arm. A TASER® may also be combined with the forend or barrel of a conventional long arm itself. Stud posts come standard on certain long arms like the M-16 rifle. Stud posts can be installed on single shot and pump action shotgun forends as well. Installation kits are sold for this purpose. The TASER® and vertical grip combination eliminates the TASER®'s earlier described storage and transport disadvantages. It also eliminates many of the other of the TASER®'s problems described in U.S. Pat. No. 5,831,199 to McNulty at lines 30 to 53 of Column 3 and lines 1 to 39 of Column 4. The TASER® is less likely to be fired at an ineffectively close range because the firearm barrel extending beyond the TASER®'s launcher, serves as a stand off. Conventional firearms used for home protection need to be kept loaded, thereby, risking injury and death to innocent children and others, as the combined TASER® can serve as the first line of home defense. If a TASER® deployment should fail or if a confrontation should escalate, the peace officer or soldier would have the conventional firearm for immediate backup. Moreover, the TASER® may alternately serve as a signaling device or rescue beacon for both combatants or sportsmen in need of rescue. The TASER® power supply can serve as a power source for a strobe lamp, which may be sighted by rescuers either visually or with infrared night viewing or other special viewing equipment for miles. The optical signal could be produced in the infrared, visible light and ultraviolet light regions of the electromagnetic spectrum. Visible light occupies the region with wavelengths from approximately 400 nanometers to 700 nanometers. When produced outside of the visible light region of the spectrum the signal would be visible to rescuers with special viewing equipment while the signaler remained concealed to less technically sophisticated enemies. The signal lamp is inserted into a TASER®'s firing chamber in lieu of an ammunition cartridge. The TASER® power supply's high voltage output might alternatively be switched from the TASER®'s firing chamber to the lamp. It would be undesirable to operate both the lamp and shock circuits simultaneously as this would likely give away the combatant's position to his enemies. With either configuration, after the lamp or beacon is switched on, the frequency of the power output might be decreased to extend operation time. When detached from the rifle, the forend grip lantern might also serve as a roadside hazard marker or as a landing zone marker for emergency helicopters.

The power supply ammunition contacts at the ammunition chamber on the TASER® receiver are normally one and one quarter inch distant from each other. A typical TASER® power supply operates with sufficient energy to otherwise produce high tension currents, which can arc an open air gap of up to one and a half inch. The need for arcing currents is discussed at Col. 2, 11 9-20 of U.S. Pat. No. 5,831,199. Said lines of the patent text are incorporated herein by reference as though fully set forth herein. TASER® is a category of electronic control device that connects a remote power supply to a human or other animal target to either disable the target or shock it into submission.

When a combination operator places her or his hand over the dielectric housing of the TASER® to support the TASER® receiver's high tension power supply and its ammunition contacts, an anatomical conductor that is proximate to the ammunition contacts and metal conductor of the long arm exists on the housing surface. The operator's trigger hand and other anatomy supporting other portions of the combination weapon are now also adjacent manufacturing seams of the TASER® and metal conductor of the long arm and in continuity with other of the shooter's body parts, which are adjacent ground. A myriad of potential paths then exist through which current can arc to complete a circuit path through the operator and between the ammunition contacts when the TASER® is energized. This is especially the case during electrical operation of the TASER® after detonation of its ammunition round and where one of the TASER®'s paired ammunition electrodes has missed a remote conductive target or, in other words, while the shocking circuit is open at the target. Significant perceptible capacitive leakage may also develop.

An embodiment of a prior art model M-26-A concept, M16 and TASER® combination weapon, disclosed in paper *M26 Less Lethal EMD Weapon and M26A Dual Less Lethal/Lethal Integrated M16 Platform Weapon*, presented at NDIA Non-Lethal Defense IV, Mar. 20-23, 2000 by Smith, 25 pages, Taser International, Homeland Securities and Defense Opportunities Conference. This embodiment can be observed to successively shock operators through various of these current paths when it is energized after its ammunition is detonated and with its shocking circuit open at the target. A May 5, 2008 study of the National Institutes of Justice, titled *A Qualitative & Quantitative Analysis Of Conductive Enemy Devices: TASER® X26 vs. Stinger*, reported that in an astounding 83 of 216 TASER® test firings, one ammunition electrode failed to strike a target to complete a shocking circuit through the target (circuit open at target), that is a failure rate of over 38%! See Table 3 at page 49 and Table 4 at page 51 of the study. The TASER® tested was a model X26 TASER®, manufactured by Taser International, Inc., headquarters in Scottsdale, Ariz. At time of this application, the Taser International, Inc. model X26 was the number one selling TASER® weapon in the U.S. If such a TASER® were joined in ill considered placement in combination with a long arm, frequent user shocks could be anticipated. To maintain a combination weapon shooter isolated from such likely shocks, a member, can be placed a minimal one and one quarter inch distance behind the housing's ammunition contacts and the contacts are maintained a minimum one and one quarter inch distance from the metal conductor of the long arm after fastening. When the TASER®'s shocking circuit is now open at the target, the member will provide a parallel path that safely shunts an otherwise shocking current away from the operator. The member may also be fashioned to discourage the operator's placement of his or her hand in front of the member and more adjacent the ammunition contacts. The operator can contact the shunting member without being disabled by a shock. The member may be integral with the electronic control device or non-integral therewith.

The model M26A TASER®, the model M26 TASER® and the model X26 TASER® all have an ammunition chamber (that unlike the chambers of the prior art models TF1, TF76 and TF76A TASER®'s, manufactured by Taser Systems, Inc.) does not contain its power supply's ammunition contacts inside the chamber and, certainly, not inside the chamber with one contact behind the other.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which.

DETAILED DESCRIPTION OF A PREFERRED EMBODIMENT

Figure 1:
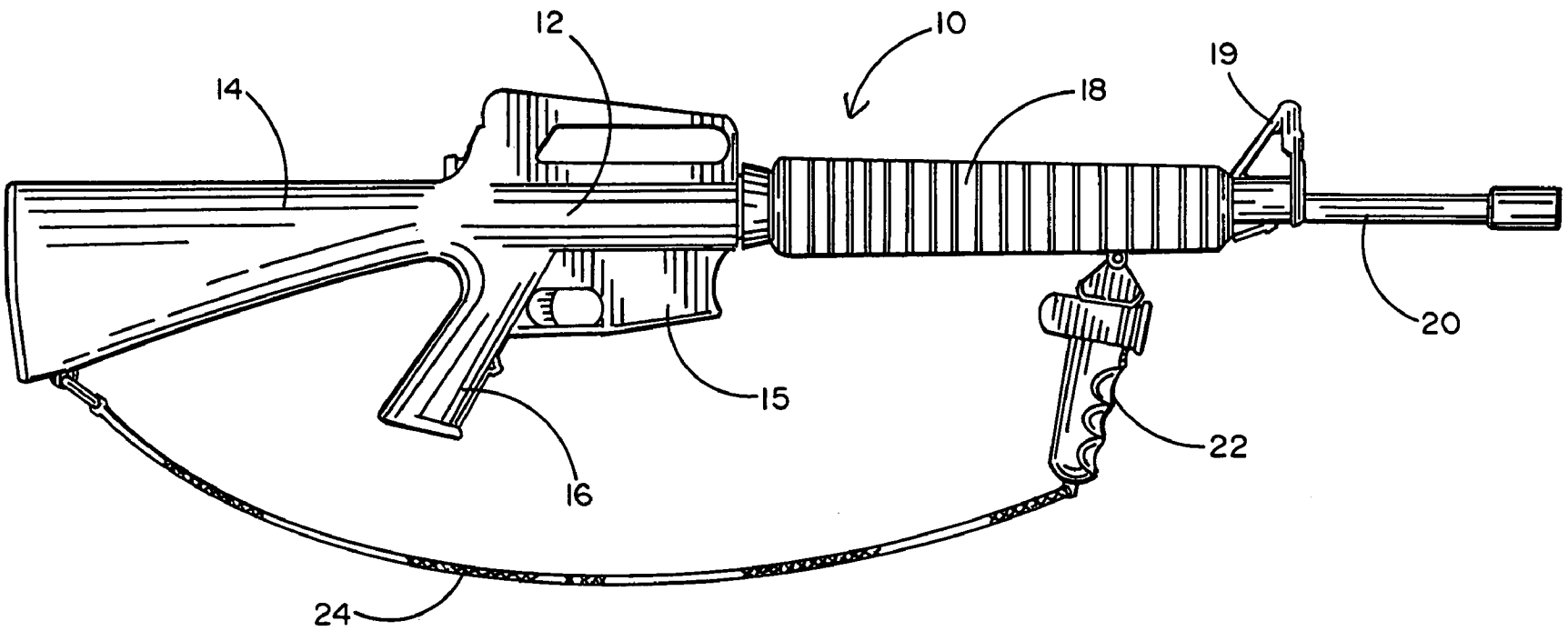
FIG. 1 is a side view of the invention shown installed on an M16 rifle.
Figure 2:
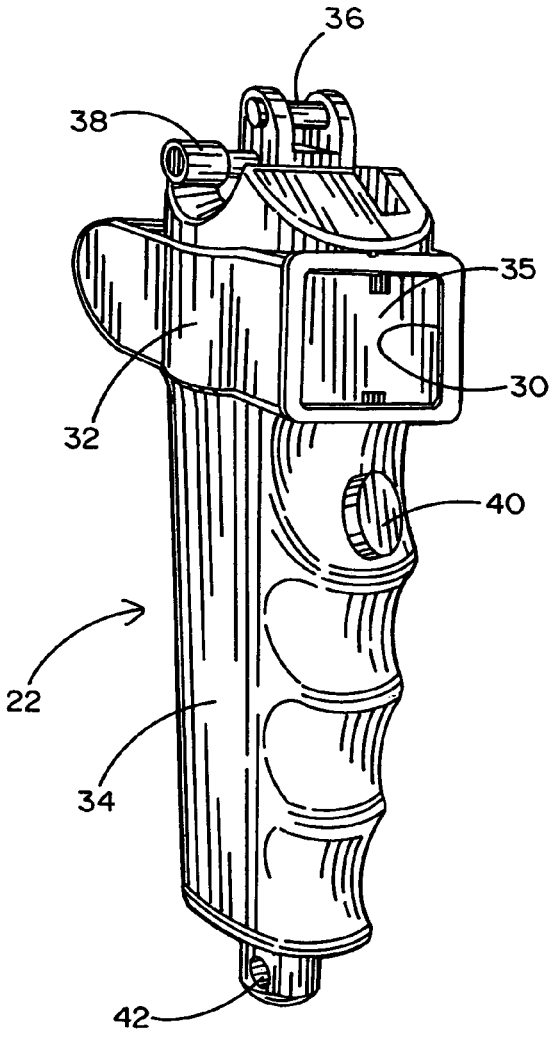
FIG. 2 is a three-dimensional view of a preferred embodiment of the invention.
Figure 3:
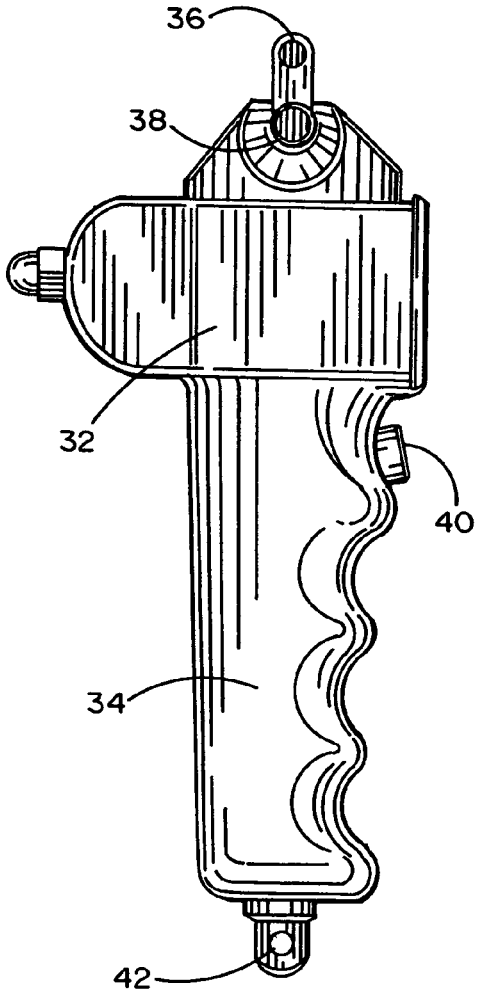
FIG. 3 is an enlarged side view of the embodiment of FIG. 2.

Referring to the accompanying drawings and particularly FIG. 1, it will be seen that a rifle 10 comprises a main body 12, a butt stock 14, a magazine receptacle 15, a pistol grip 16, a hand guard 18, a sight 19, a barrel 20, a forend grip 22 and a sling 24. The rifle depicted in FIG. 1 will be recognized as an M16A2 semiautomatic rifle which is currently the U.S. military standard. However, the present invention is not limited to deployment in an M16A2 rifle which is shown in FIG. 1 solely for purposes of illustrating the preferred configuration of the invention and its preferred method of attachment to a rifle. The invention herein resides in the forend grip 22 which uniquely provides an additional and highly advantageous function of backup weapon and/or strobe light. A prior art standard vertical forend grip, such as that grip sold under the trademark "Steadyhold" by Steadyhold Products of Cedar Rapids Iowa or the grip sold under the Trademark "Ergogrip" by Falcon Industries of Tijeras, N.M., is know in the firearms trade as an after-market accessory for rifles. It provides a comfortable additional holder for the non-trigger hand and adds a stabilizing function for better accuracy. It is typically a substantially monolithic, rubberized structure having means for attachment to the rifle along the barrel or hand guard.

The preferred embodiment of the present invention provides a vertical forend grip substitute which, for the most part, retains the external configuration of prior art grips. However, in the present invention the grip is configured to enclose a batter and electronics to house a TASER® immobilization weapon having a chamber for receiving a TASER® cartridge. The preferred embodiment of this unique, grip-configured TASER® apparatus is seen best in FIGS. 2-5.

Grip 22 will be seen as comprising a chamber 30 in a housing 32 integrally constructed as a part of the grip body 34. The latter is hollow to provide an interior for receiving a battery and electronics (not shown) for TASER® weapon operation. Such electronics are well known in the TASER® art and need not be described herein in any detail. Suffice it to say that such electronics are substantially the same as those described in U.S. Pat. Nos. 3,803,463 and 4,253,132 to Cover, the content of which is hereby incorporated herein by reference as if fully set forth herein. Chamber 30 receives a standard two-wire tethered dart cartridge 35 which may be selectively activated by a trigger switch 40. Grip/TASER® 22 is attached to the rifle using a grip latch 36 and a latch lock 38, both of which are prior art elements of the existing forend grip and need not be described herein in greater detail. A sling hook 42 permits the sling 24 to be attached to the grip/TASER® 22 in a conventional manner.

Figure 5:
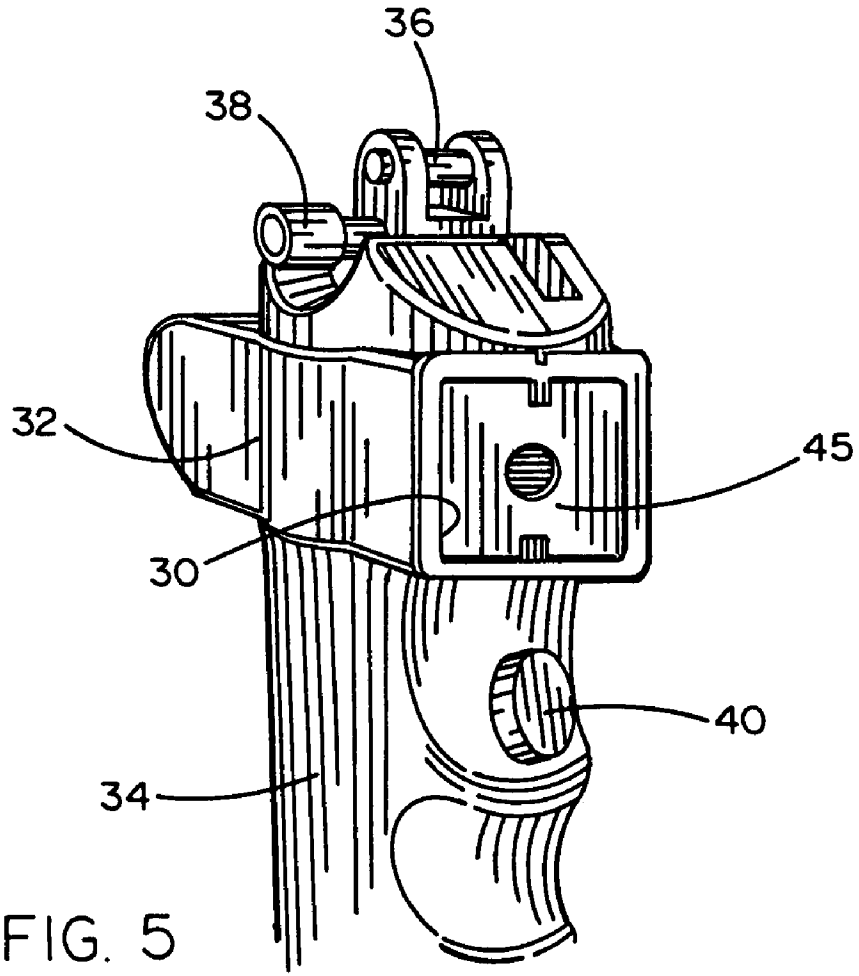
FIG. 5 is a partial three-dimensional view showing the preferred embodiment with a strobe light installed in the invention instead of a TASER® cartridge.
Figure 4:
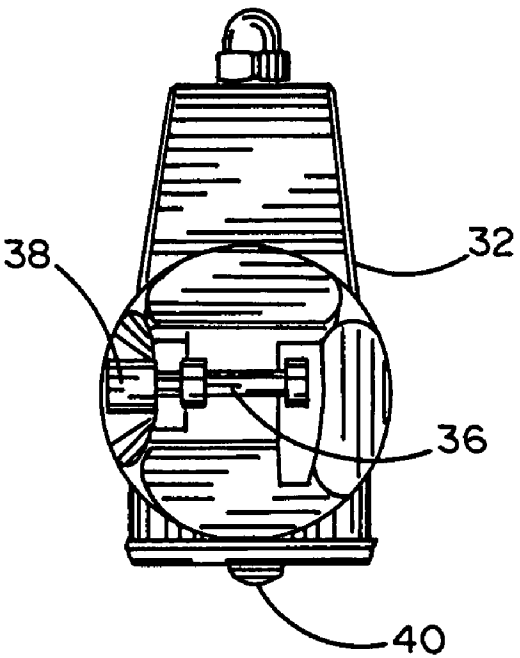
FIG. 4 is a top view of the embodiment of FIG. 2.
Figure 7:
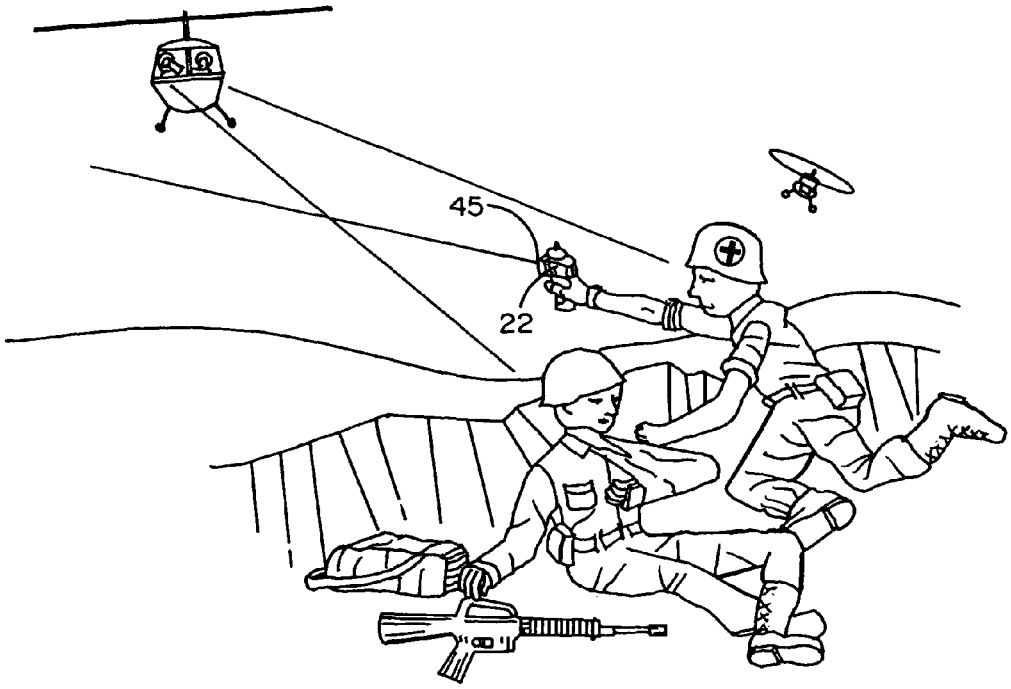
FIG. 7 illustrates a military scenario for use of the preferred embodiment with a strobe light or infrared light attachment.
Figure 8:
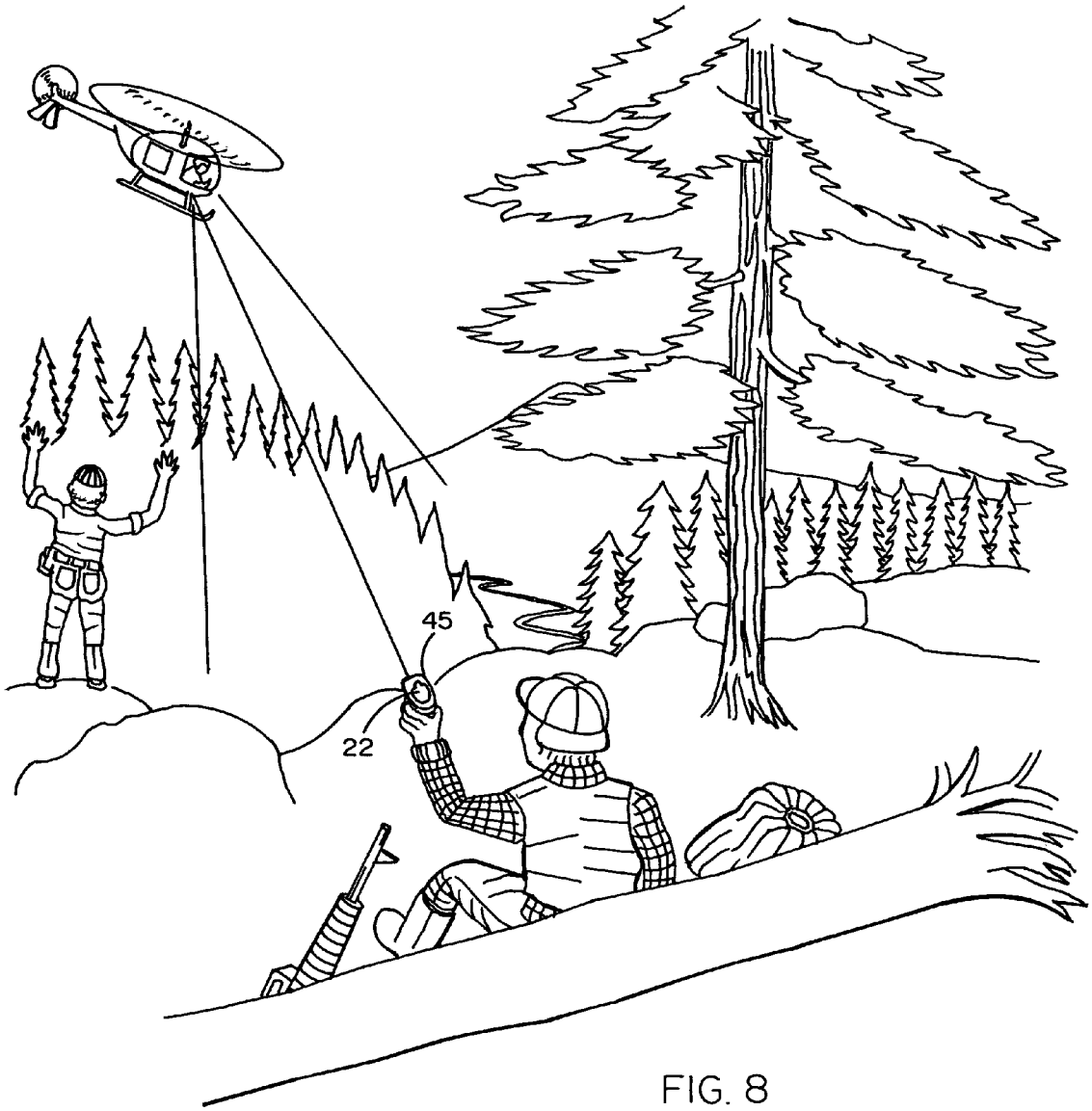
FIG. 8 illustrates a non-military scenario similar to that of FIG. 7.

Because the TASER® cartridge is typically activated by a high voltage pulsed signal, cartridge 35 may be replaced by a strobe light 45 as shown in FIG. 5 which, in the preferred embodiment herein, is configured to operate at the same voltage and pulse rate to provide a visual signal as depicted in FIGS. 7 and 8. The light from strobe 45 may be either in the visual spectrum or in the infrared, the latter providing surreptitious optical signaling in a hostile environment. A shown in FIGS. 7 and 8, it may be desirable to remove grip/TASER® 22 from the rifle to facilitate its use as an optical signaling device.

Figure 6:
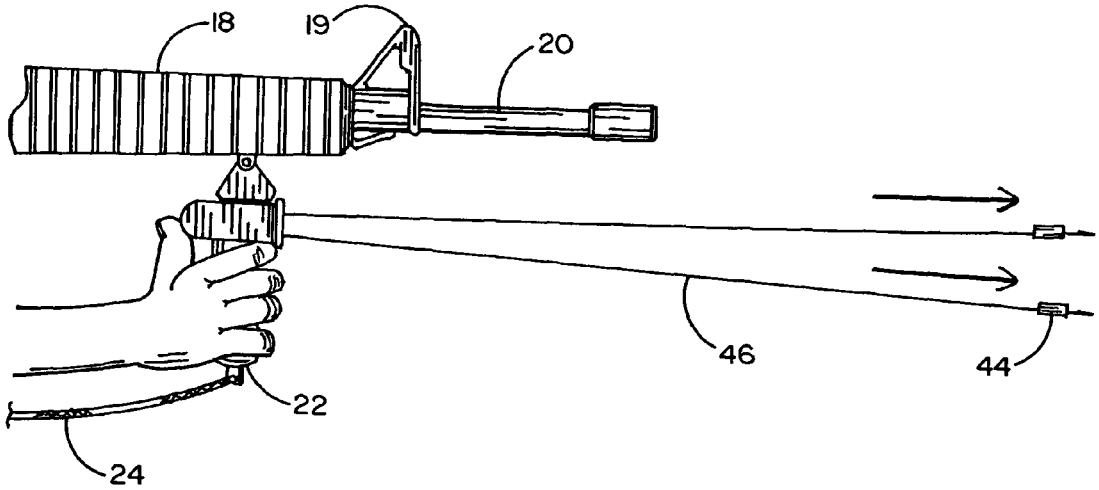
FIG. 6 is a partial side view of the invention shown on a rifle and being used to propel wire-tethered electrode darts toward a target.

Operation of the preferred embodiment of the invention is depicted in FIG. 6 which illustrates deployment of the grip/TASER® 22 as an immobilization weapon. More specifically, the trigger switch 40 has been depressed thereby activating propellant in the cartridge 35 to propel darts 44 toward a target, each such dart being tethered by a thin wire 46 to the electronics in the grip/TASER® body 34.

Figure 10:
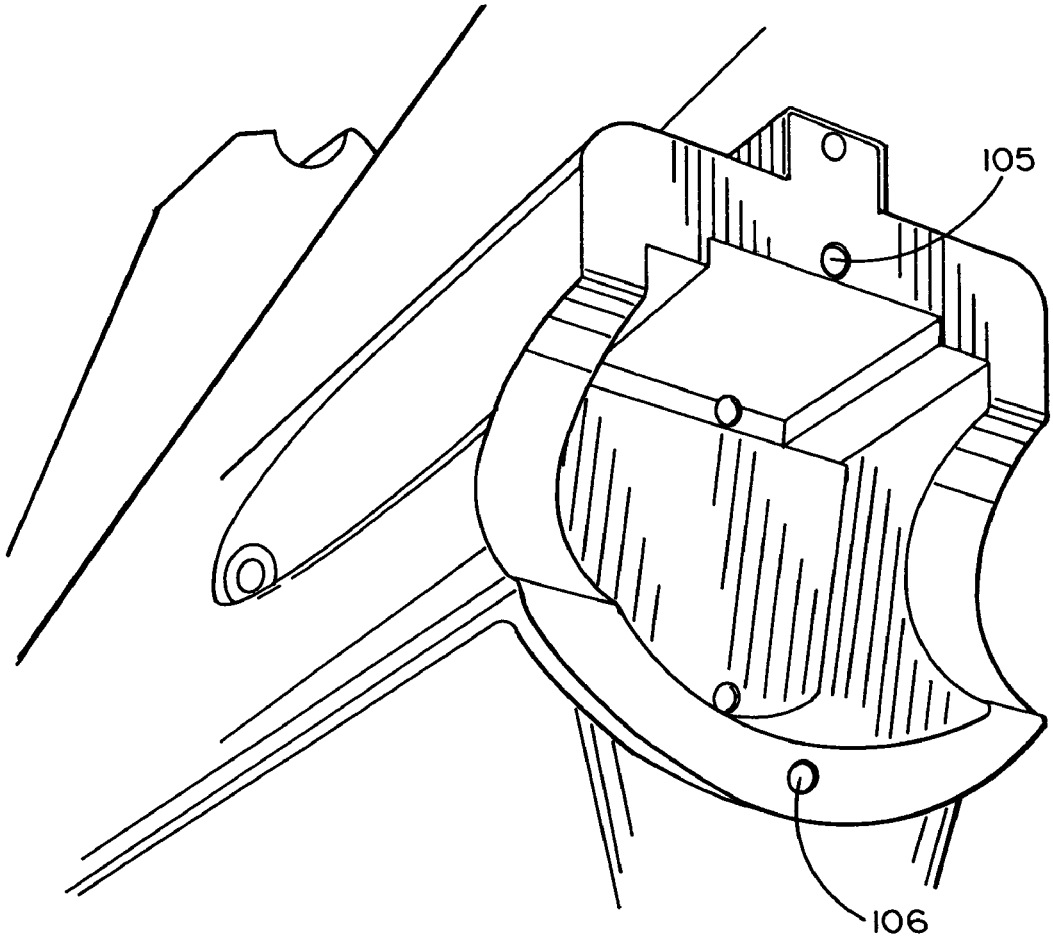
FIG. 10 is a perspective front view of the combination showing the electrical contacts of the TASER®'s chamber for receiving a TASER® ammunition cartridge.
Figure 11:
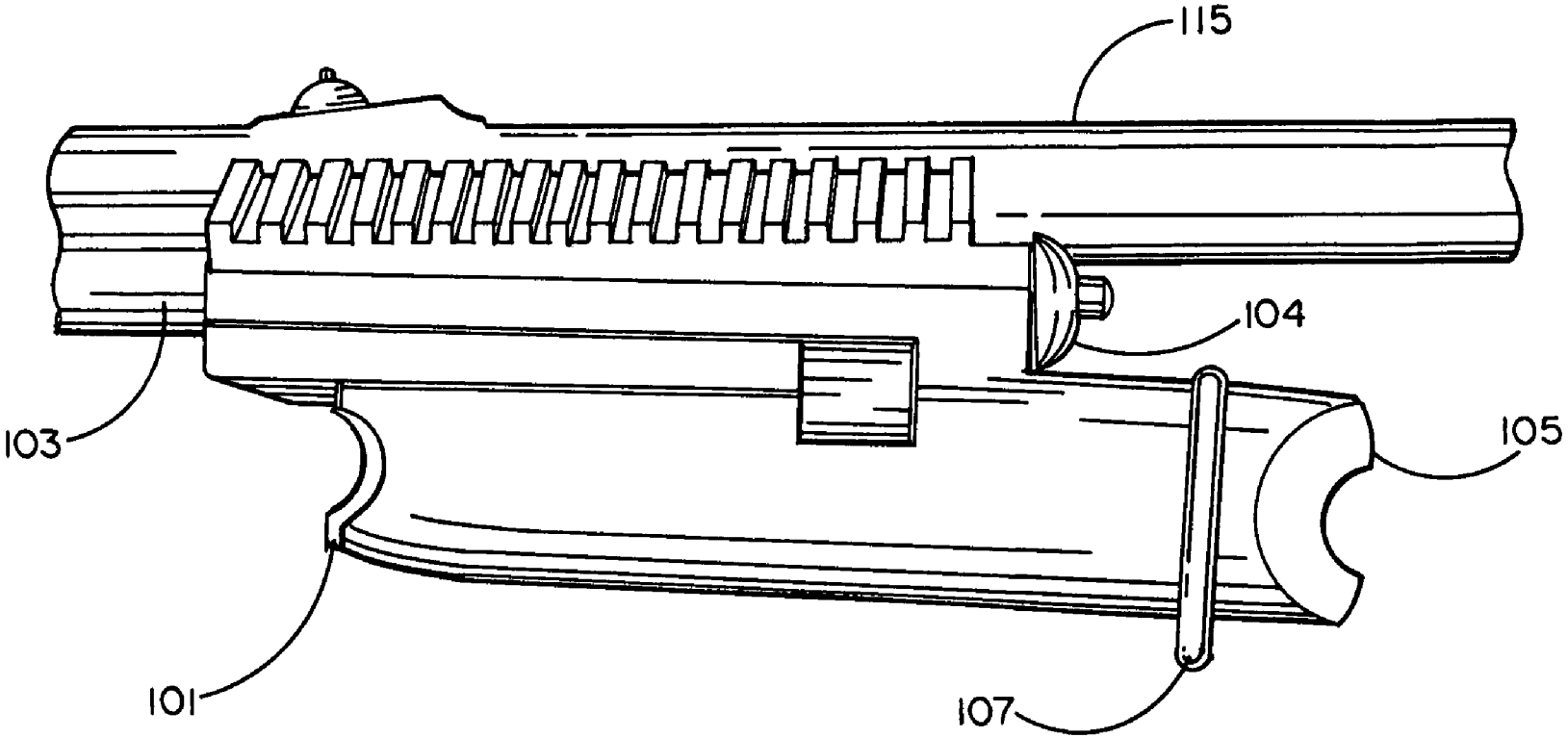
FIG. 11 is a side view of the combination including a TASER® and a pump action shotgun.

Referring to the accompanying FIGS. 10-11, TASER® 101 is secured for illustrative purposes to a Remington 870 pump action shotgun 115 about its magazine tube 103 by magazine cap fastener 104. Power supply ammunition contacts 105 and 106 are one and one quarter inch distant from each other and are placed with a minimum air gap of one and one quarter inch between any contact and metal of the shotgun. A conductive metal band 107 surrounds the TASER® one and one quarter inches behind the closest contact. In the alternative, the band might also comprise a polymer, injection molded in combination with barium sulfate or having graphite paint or other surface conductor. The TASER® fires the same ammunition cartridge fired by the models M26 TASER® and the model X26 TASER®, manufactured by Taser International Inc. When the TASER® is energized, the ammunition round's two electrode darts or missiles 108 and 109, which are each electrically connected to a different one of the polarized contacts by tethering conductor, are propelled toward a remote target. Should either electrode fail to secure itself sufficiently close to a target's anatomy for current to arc and conduct between the electrodes through the target and shock the target, then, the current will arc back to harmlessly complete a circuit between the contacts through metal band 107 and contacts 105 and 106. If the shooter's hand contacts metal band 107, he or she shall not receive a disabling shock because metal conductor has a maximum resistance of just $10^{-6}$ Ohms (10 millionth of an Ohm) per cm while the internal resistance of a human body, which is a volume conductor of electricity, is estimated to be between 200 Ohms and 1000 Ohms, and this parallel circuit will also likely have air gaps with a dielectric strength of 80 volts per mil prior to breakdown and skin resistances.

Figure 9:
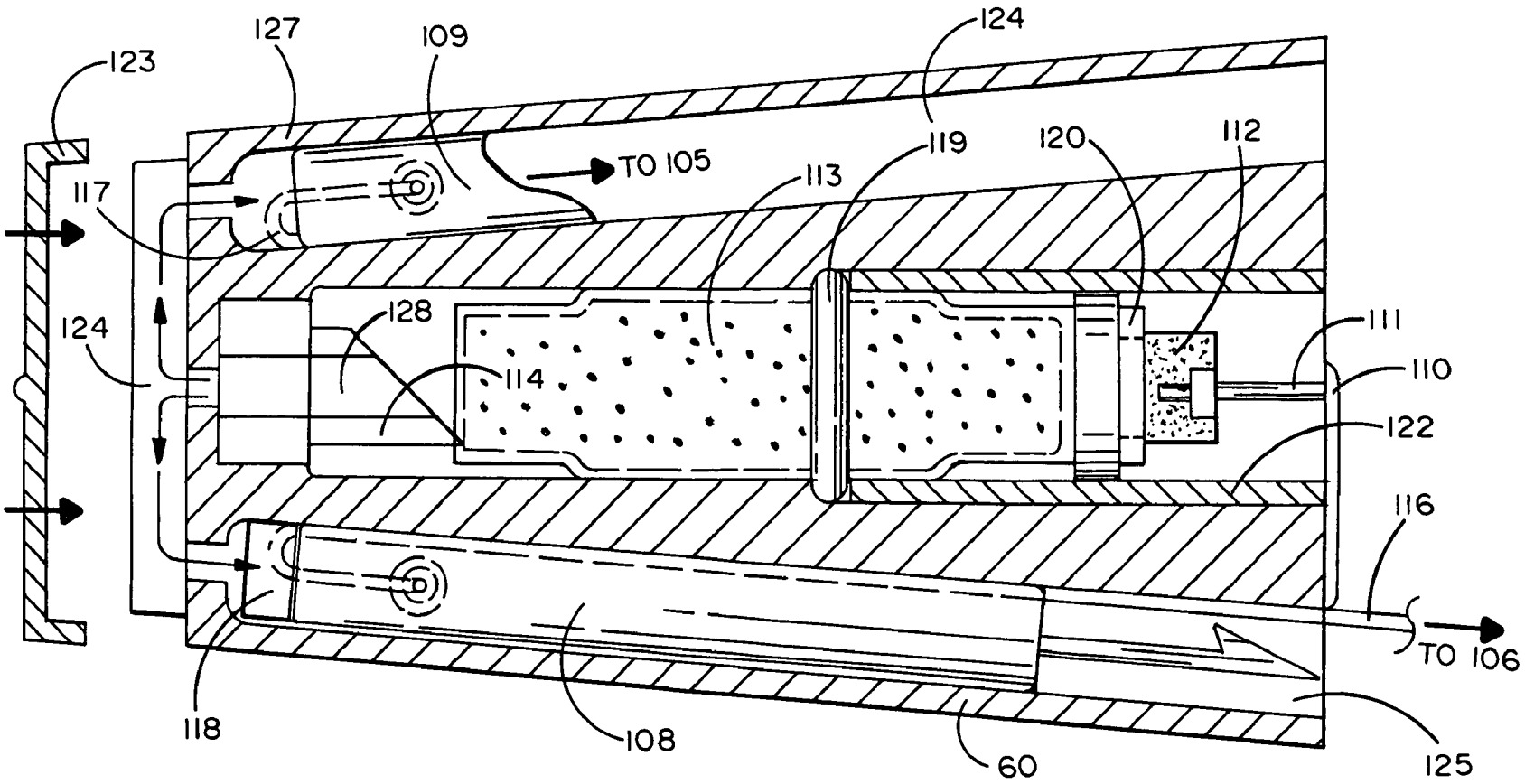
FIG. 9 is a cross sectional view of an ammunition cartridge or round of the type to be fired from a model M26A TASER®, a model M26 law enforcement TASER®, a model X26 TASER®, model U34000 consumer and law enforcement or AIR TASER®.

Referring now to the FIG. 9 cross section of the ammunition cartridge or round, lower dart 108 is electrically connected to power supply contact 106 by cartridge tethering conductor 116 which is compacted into the cartridge and not fully illustrated. Upper dart 109 is electrically connected to the opposed power supply contact 105 by cartridge tethering conductor 117 which is compacted into the cartridge and not fully illustrated. When the TASER® power supply is energized, current arcs from dart 108 to foil conductor 110, which is adhered to a frangible ammunition cartridge front cover plate (not shown). Current then conducts to the pin 111 and though pin 111 to the metal case of large boxer type rifle primer 112, which has its metal anvil removed. The current arcs through the primer's combustive powder and the air gap between the primer case or cup and the metal canister 113. It then arcs from the canister through the lumen 128 of piercing member 114 to opposed dart 109.

The priming compound detonates and drives canister 113 into piercing member 114. The canister ruptures suddenly releasing its compressed nitrogen gas content. The rapidly expanding gas forces darts 108 and 109 from the cartridge which dislodges the frangible cartridge front cover plate and its adhered foil conductor 110. The darts 108 and 109, which diverge from each other at a fixed angle of 7° in flight, quickly become sufficiently distant from each other that an arcing current can no longer complete a circuit through the atmosphere between the darts 108 and 109 until they both lodge sufficiently adjacent a conductor for the circuit to again close. The darts angle away from each other in flight to optimize the volume of musculature involved in the shock when the circuit again closes most desirably upon electrode darts 108 and 109 both impaling into a human target and/or its garment.

Each dart remains tethered to the cartridge adjacent its respective ammunition chamber contact by its trailing conductor (116 and 117, respectively). The tethering conductor is 36 AWG copperweld. The 4 mil diameter conductor is coated with an 8 mil wall of tefzel, having a dielectric strength of 2 KV per mil, to form a tethering wire with an O.D. of 20 mil. Such tefzel insulated wire is manufactured by and available from Almont Wire & Cable, Inc. in Santa Ana, Calif.

If the circuit cannot complete between darts 108 and 109, it seeks to complete a path to contact 105 and/or 106 back at the combined weapon. This path may include a path from a grounded electrode dart to a contact or an, otherwise, disabling passage through the combination's operator.

The cartridge also comprises gas sealing and isolating members 118 (AFID wad), 119 (polypropylene O ring), 120 (steel washer), 121 (porous foam cushion), 123 (bonded back cover plate), 122 (plastic insert for cooperatively forming combustion chamber with O ring 119, steel washer 120, foam cushion 121 and casing of primer 112, 126 (cylinder chamber) and 124, 125 (ammunition or shot bores). Bonded parts are secured with adhesive for joining ABS piping and couplings, if plastic to plastic, and epoxy or LOCTITE, if plastic to metal. The styrene front cover plate is bonded to ABS cartridge case 127 only at its corners.

Having thus disclosed an illustrative example of the present invention, it will be understood that the disclosed embodiment is not limiting of the invention, but merely a description of its salient features in the presently contemplated best mode. By way of example, those having skill in the relevant art and having the benefit of applicant's teaching herein, will now perceive various modifications and additions which may be beneficial. Other structures, means for attachment to a rifle and activation will almost certainly come to mind, particularly in conjunction with other rifles. Thus, the scope hereof is to be limited only by the appended claims and their equivalents.

I claim:

1. A long arm and an electronic disabling device that are joined by at least one fastener to form a combination weapon comprising:

a chamber for seating an ammunition cartridge, in the electronic disabling device for firing electrode darts at a remote target;

a power supply with exposed contacts for electrical connection to the ammunition cartridge for shocking through atmosphere at high tension;

a solid member which a current can transit;

wherein the member and the power supply contacts are located to cooperate to prevent a current passing between the electrodes from shocking a combination operator whose hands are behind the member when the combination weapon is electrically energized.

2. The combination recited in claim 1 wherein the solid member is configured so a shooter may contact the energized member without receiving a disabling shock.

3. The combination recited in claim 1 wherein said solid member comprises at least one rib.

4. The combination recited in claim 1 wherein said solid member comprises at least one fin.

5. The combination recited in claim 1 wherein said solid member comprises at least one band.

6. The combined weapon recited in claim 1 wherein said solid member comprises barium sulfate filler.

7. The combined weapon recited in claim 1 wherein said solid member comprises separated solid surface particles which are electrically conductive.

8. The combined weapon recited in claim 1 wherein said solid member contains an integral solid conductor molded into the member.

9. A combined long arm and an electronic discharge device comprising:

a chamber for seating an ammunition cartridge into the electronic discharge device for firing electrode darts at a remote target;

a power supply with exposed contacts for electrical connection to the ammunition cartridge for shocking through atmosphere at high tension;

a solid member which a current can transit;

wherein the solid member and the power supply contacts are located to cooperate to prevent a current from shocking a combination operator whose hands are behind the member when the combination weapon is electrically energized.

10. The combined weapon recited in claim 9 wherein the solid member is implemented so a shooter may contact the energized member without receiving a disabling shock.

11. The combined weapon recited in claim 9 wherein said solid member comprises at least one rib.

12. The combined weapon recited in claim 9 wherein said solid member comprises at least one fin.

13. The combined weapon recited in claim 9 wherein said solid member comprises barium sulfate filler.

14. The combined weapon recited in claim 9 wherein said solid member comprises separated solid surface particles which are electrically conductive.

15. The combined weapon recited in claim 9 wherein said solid member contains an integral solid conductor molded into the member.

16. A method including the steps of:

supplying a long arm;

providing an electronic discharge device comprising:

a chamber for seating an ammunition cartridge into the electronic discharge device for firing;

a power supply with exposed contacts for electrical connection to the ammunition cartridge for shocking a remote target with darts for shocking at high tension fired through the atmosphere;

a solid member which a current can transit to protect a shooter from being shocked by the current;

the method further comprising the steps of:

fastening the long arm to the electronic discharge device to form a combination weapon;

seating an ammunition cartridge in the chamber;

energizing the electronic discharge device to fire from the electronic control device and toward a remote target electrodes that may each miss the target and cause current to transit the member to prevent the shooter of the combination weapon from inadvertently being shocked.

* * * * *